US007560870B2

(12) United States Patent
Tamida et al.

(10) Patent No.: US 7,560,870 B2
(45) Date of Patent: Jul. 14, 2009

(54) POWER SUPPLY APPARATUS FOR ION ACCELERATOR

(75) Inventors: Taichiro Tamida, Chiyoda-ku (JP); Takafumi Nakagawa, Chiyoda-ku (JP); Ikuro Suga, Chiyoda-ku (JP); Hiroyuki Osuga, Chiyoda-ku (JP); Toshiyuki Ozaki, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 406 days.

(21) Appl. No.: 11/613,479

(22) Filed: Dec. 20, 2006

(65) Prior Publication Data

US 2007/0145901 A1 Jun. 28, 2007

(30) Foreign Application Priority Data

Dec. 27, 2005 (JP) ..... 2005-374204

(51) Int. Cl.
*H01J 27/02* (2006.01)

(52) U.S. Cl. ..... 315/111.81; 315/111.91

(58) Field of Classification Search ..... 315/111.21, 315/11.31, 111.41, 111.51, 111.61, 111.71, 315/111.81, 111.91
See application file for complete search history.

(56) References Cited

U.S. PATENT DOCUMENTS 6,448,721 B2 * 9/2002 Raitses et al. ..... 315/501
7,312,579 B2 * 12/2007 Zhurin ..... 315/111.41
2007/0145901 A1 6/2007 Tamida et al.

FOREIGN PATENT DOCUMENTS

JP 2002-517661 6/2002
JP 2005-282403 10/2005

OTHER PUBLICATIONS

U.S. Appl. No. 11/866,062, filed Oct. 2, 2007, Tamida, et al.
K. Kuriki, et al., "Introduction to Electric Propulsion Rockets", University of Tokyo Press, 2003, pp. 152-155.
N. Yamamoto, et al., "Discharge Current Oscillation in Hall Thrusters", Journal of Propulsion and Power, vol. 21, No. 5, 2005, 7 pages.

* cited by examiner

*Primary Examiner*—David Hung Vu
(74) *Attorney, Agent, or Firm*—Oblon, Spivak, McClelland, Maier & Neustadt, P.C.

(57) ABSTRACT

A power supply apparatus for controlling a Hall thruster which is an ion accelerator includes an anode power supply for applying anode voltage Va to an anode of the Hall thruster, inner and outer coil power supplies for supplying coil current Ic to each of inner and outer magnetic field generating coils of the Hall thruster, a gas flow rate controller for regulating gas flow rate Q via a gas flow rate regulator, and a control unit. The control unit adjusts the magnitude of ion acceleration by the Hall thruster by controlling the anode voltage Va, the gas flow rate Q and the coil current Ic according to a quantity expressed by a function related to the anode voltage Va and the coil current Ic.

9 Claims, 8 Drawing Sheets

POWER SUPPLY APPARATUS FOR ION ACCELERATOR

BACKGROUND OF THE INVENTION

1. Field of the Invention

The present invention relates to a power supply apparatus for an ion accelerator which is an electric discharge device for accelerating ions. More particularly, the invention pertains to a power supply apparatus for a Hall thruster which is an electric propulsion device mounted on an artificial satellite, for example.

2. Description of the Background Art

A Hall thruster introduces gas from one end of an annular discharge channel, ionizes and accelerates the gas therein, and ejects the ionized gas through the other end of the discharge channel. The Hall thruster produces a thrust due to reaction of an outgoing flow of ions from the discharge channel. A radial magnetic field is formed in the annular discharge channel. The Hall effect produced by the radial magnetic field causes an azimuthal drift of electrons within the annular discharge channel so that the electrons are kept from moving in an axial direction of the channel. This configuration makes it possible to accelerate only the ions with high efficiency as described in Japanese Patent Application Publication No. 2002-517661, for instance.

One problem which could hinder stable operation of a Hall thruster is the occurrence of a discharge oscillation phenomenon. Several types of discharge oscillations are known, among which the discharge oscillation occurring at a lowest frequency is ionization oscillation which occurs at a frequency around 10 kHz. The ionization oscillation is crucial to a system equipped with a Hall thruster because the ionization oscillation can seriously affect stability, reliability and durability of the system as discussed in a non-patent document entitled "Introduction to Electric Propulsion Rockets," K. Kuriki and Y. Arakawa, University of Tokyo Press, p. 152-154, 2003, for instance. On the other hand, a previous effort toward formulating conditions under which the discharge oscillation phenomenon occurs in Hall thrusters is presented in another non-patent document entitled "Discharge Current Oscillation in Hall Thrusters," N. Yamamoto, K. Komurasaki and Y. Arakawa, Journal of Propulsion and Power, Vol. 21, No. 5, p. 870-876, 2005, for instance.

A conventional power supply apparatus for an ion accelerator designed to suppress the discharge oscillation phenomenon is configured such that when anode current fluctuates, causing a load to begin exhibiting unstable behavior, the anode current is fed back to a power supply controller, which prevents anode current fluctuations based on the value of the anode current which has been fed back. This feedback control approach is disclosed in Japanese Patent Application Publication No. 2005-282403, for instance.

When the anode current fluctuates, the conventional power supply apparatus suppresses the anode current fluctuations based on the value of the anode current fed back to the power supply controller as mentioned above. This approach involves detecting the beginning of anode current fluctuation. This means that the conventional feedback control approach does not prevent the discharge oscillation phenomenon in principle. It is difficult therefore to essentially improve stability of the Hall thruster. Also, since the discharge oscillation has a frequency of 10 kHz, for instance, the aforementioned conventional approach to preventing the discharge oscillation by feedback of the anode current to the power supply controller requires the provision of a fairly high-speed control system. If the control system can not return a response at high speed, the power supply apparatus would not be able to control the anode current in stable fashion, potentially causing increased instability of the Hall thruster due to oscillatory interaction between the Hall thruster and the control system.

SUMMARY OF THE INVENTION

In light of the foregoing, it is an object of the invention to provide a power supply apparatus configured to permit stable operation of a Hall thruster which is an ion accelerator by preventing discharge oscillation.

According to the invention, a power supply apparatus for controlling an ion accelerator which is provided with an anode, a gas flow rate regulator and a magnetic field generating coil includes a controller for adjusting the magnitude of ion acceleration by the ion accelerator by controlling anode voltage applied to the anode, flow rate of gas flowed through the gas flow rate regulator and coil current flowed through the magnetic field generating coil. The controller controls the anode voltage, the gas flow rate and the coil current according to a quantity expressed by a function related at least to the anode voltage and the coil current.

The power supply apparatus thus configured serves to suppress the occurrence of the discharge oscillation and thereby operate the a Hall thruster which is an ion accelerator in a stable fashion.

The foregoing and other objects, features, aspects and advantages of the present invention will become more apparent from the following detailed description when read in conjunction with the accompanying drawings.

DESCRIPTION OF THE PREFERRED EMBODIMENTS

Embodiments of the invention will now be described, by way of example, with reference to the accompanying drawings.

First Embodiment

Figure 1:
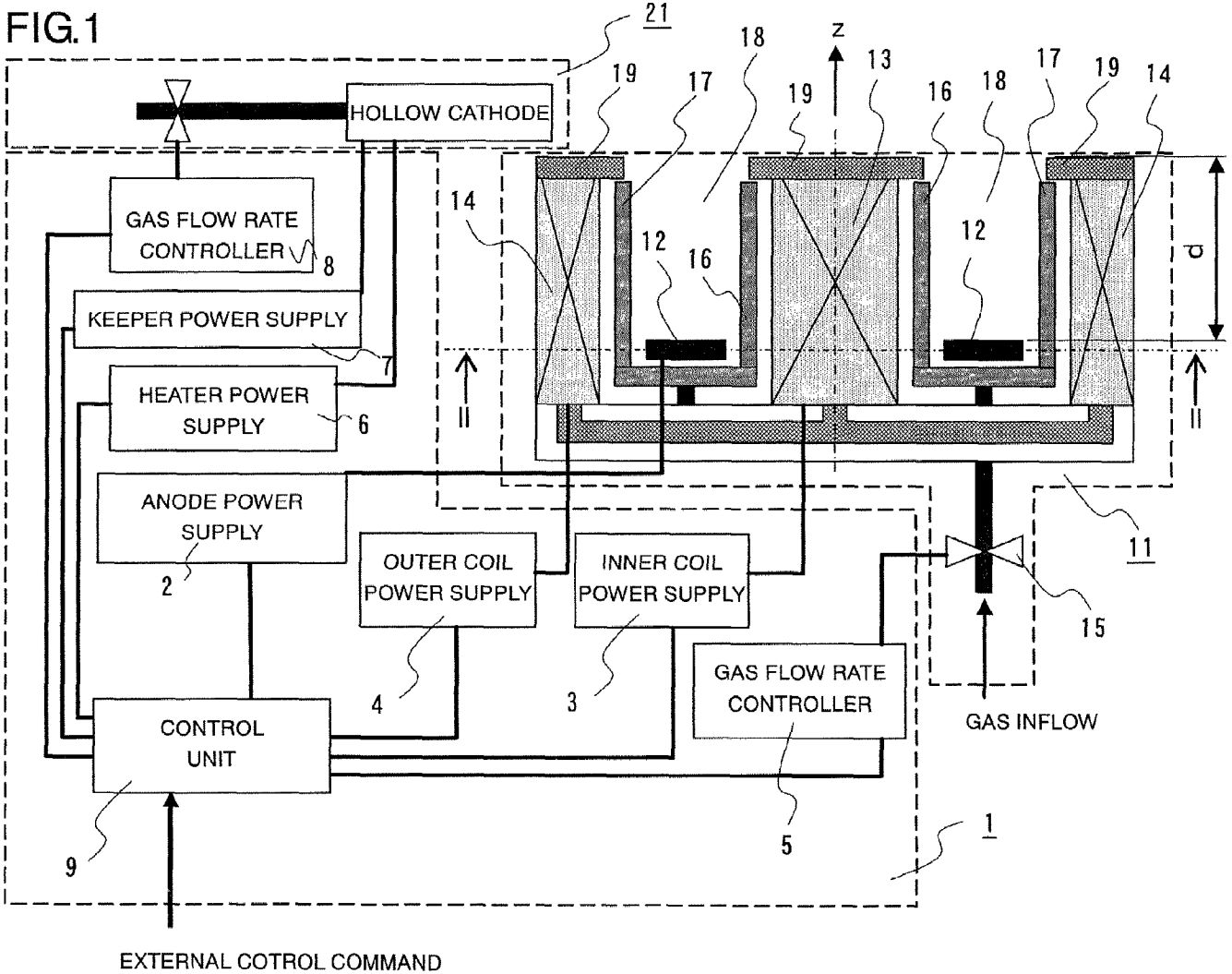
FIG. 1 is a configuration diagram of a power supply apparatus for a Hall thruster according to a first embodiment of the invention.
Figure 2:
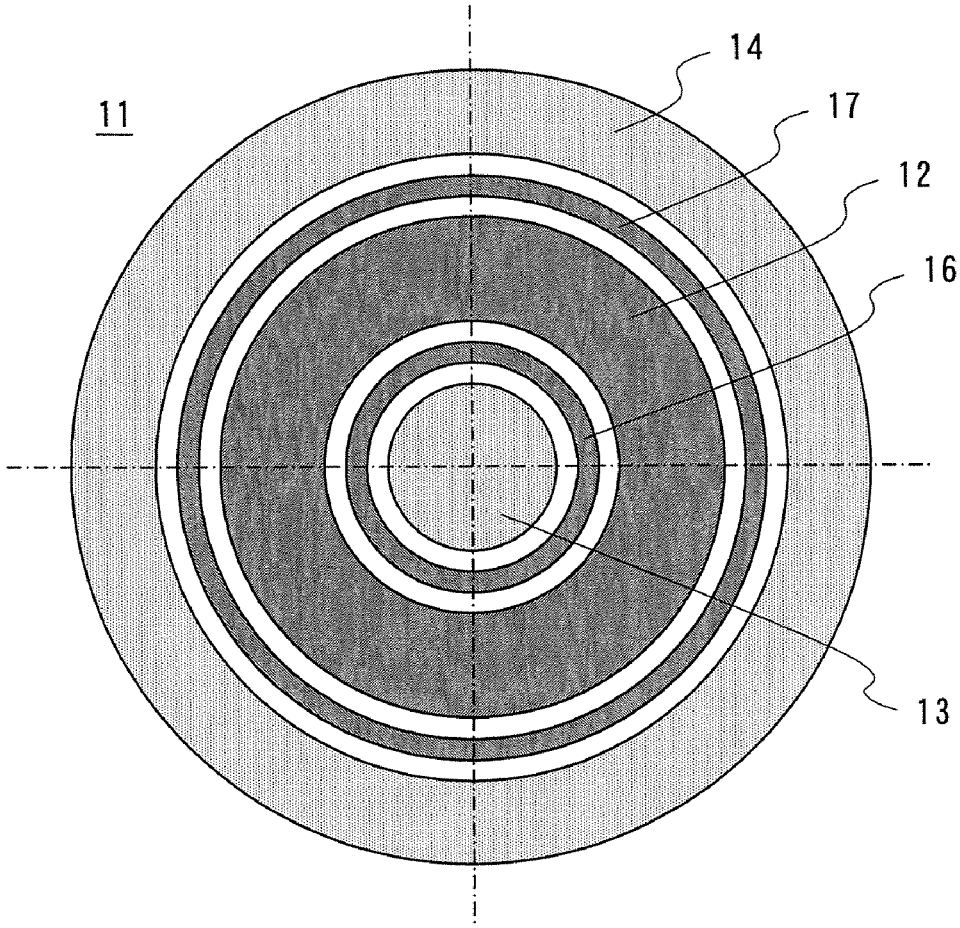
FIG. 2 is a cross-sectional diagram of the Hall thruster taken along lines II-II of FIG. 1.

FIG. 1 is a configuration diagram of a power supply apparatus 1 according to a first embodiment of the present invention. Referring to FIG. 1, the power supply apparatus 1 controls a Hall thruster 11 which is an ion accelerator as well as a hollow cathode device 21 for supplying electrons to the Hall thruster 11. FIG. 1 contains a cross-sectional diagram of the Hall thruster 11 taken by a plane containing a central axis of the Hall thruster 11 which is a device having an annular configuration. The Hall thruster 11 includes an anode 12, an inner coil 13 and an outer coil 14 for forming a radial magnetic field, a gas flow rate regulator 15, as well as an inner ring 16 and an outer ring 17 which together form a ring-shaped ion acceleration zone 18. FIG. 2 is a cross-sectional diagram of the Hall thruster 11 taken along lines II-II of FIG. 1 (or taken by a plane perpendicular to the central axis of the Hall thruster 11). The anode 12, the inner ring 16 and the outer ring 17 are concentrically arranged about the central axis of the Hall thruster 11.

Gas to be ionized is introduced from a gas inlet end of the ion acceleration zone 18 at an anode side (bottom side as illustrated in FIG. 1). The gas introduced into the ion acceleration zone 18 is ionized, producing a state known as gaseous discharge. The anode 12 is disposed at the bottom of the ion acceleration zone 18. Ionized gas particles, or ions, are accelerated in an axial direction of the Hall thruster 11 due to anode voltage Va applied to the anode 12. The gas particles accelerated through the ion acceleration zone 18 toward an open end thereof forming an ion exit (upper side as illustrated in FIG. 1) are ejected outward. The inner coil 13 and the outer coil 14 for forming the radially oriented magnetic field are provided on the inside and outside of the ion acceleration zone 18, respectively. The inner coil 13 and the outer coil 14 are magnetically interconnected by a member made of a magnetic material on the anode side, thereby forming a magnetic circuit. At ends of the inner coil 13 and the outer coil 14 on the ion exit side, there are provided pole pieces 19 for controlling magnetic flux density. Generally, the pole pieces 19 are so designed that magnetic flux generated by the inner and outer coils 13, 14 is most intensified at the ion exit and weakens on the anode side.

It is necessary to supply electrons to cause gaseous discharge. On the other hand, an electron source is required to prevent a body of an artificial satellite on which the Hall thruster 11 is mounted from being electrically charged by the ions which are accelerated and expelled. In this embodiment, the hollow cathode device 21 which supplies electrons to the Hall thruster 11 is disposed in the vicinity of the ion exit of the Hall thruster 11. This kind of Hall thruster system requires a power supply and control system for driving and controlling the Hall thruster 11 and the hollow cathode device 21.

The power supply apparatus 1 includes an anode power supply 2, a coil power supply device including an inner coil power supply 3 and an outer coil power supply 4, and a gas flow rate controller 5 which together control the Hall thruster 11. The power supply apparatus 1 also includes a heater power supply 6, a keeper power supply 7 and a cathode gas flow rate controller 8 which together control the hollow cathode device 21. The power supply apparatus 1 further includes a control unit 9 for controlling the anode power supply 2, the inner coil power supply 3, the outer coil power supply 4, the gas flow rate controller 5, the heater power supply 6, the keeper power supply 7 and the cathode gas flow rate controller 8. The power supply apparatus 1 thus configured controls the Hall thruster 11 which is the ion accelerator provided with the anode 12, the inner and outer coils 13, 14 for forming the radial magnetic field and the gas flow rate regulator 15. The anode power supply 2 applies the anode voltage Va to the anode 12. The inner and outer coil power supplies 3, 4 respectively supply coil currents Ic to the inner and outer coils 13, 14 for forming the radial magnetic field. The gas flow rate controller 5 regulates gas flow rate Q via the gas flow rate regulator 15. The control unit 9 adjusts the magnitude of ion acceleration by the Hall thruster 11 by controlling the anode voltage Va applied to the anode 12, the coil current Ic supplied to each of the inner and outer coils 13, 14 and the flow rate Q of the gas flowed through the gas flow rate regulator 15. As will be explained in the following, the control unit 9 controls the anode voltage Va, the coil current Ic and the flow rate Q according to a quantity expressed by a function related at least to the anode voltage Va and the coil current Ic.

The gas flow rate controller 5 controls the gas flow rate Q at the gas inlet of the Hall thruster 11 according to a command fed from the control unit 9. Also, the inner and outer coil power supplies 3, 4 control the coil currents Ic flowed through the inner and outer coils 13, 14 according to a command fed from the control unit 9. The coil current Ic flowed through each of the inner and outer coils 13, 14 is normally a constant direct current (DC) by which the magnetic field having a constant intensity is created in the ion acceleration zone 18. The current flowing through the inner coil 13 and the current flowing through the outer coil 14 that are supplied respectively from the inner and outer coil power supplies 3, 4 can be set independently of each other. This permits fine adjustment of magnetic flux density and magnetic field distribution within the ion acceleration zone 18. In this embodiment, the coil currents Ic having the same value are individually supplied to the inner and outer coils 13, 14.

The anode power supply 2 controls the anode voltage Va applied to the anode 12. During steady-state operation, the anode power supply 2 supplies the anode voltage Va of a constant value is applied to the anode 12. Ions created in the ion acceleration zone 18 are accelerated by the anode voltage Va whereby the Hall thruster 11 produces a thrust. Typically, the anode voltage Va is set within a range of 100 to 400 V. An ion current generated by the accelerated ions and an electron current generated by the electrons traveling in a discharge channel are caused to flow in a circuit due to the anode voltage Va. Thus, the anode power supply 2 constituting a portion supplying the Hall thruster 11 with energy for producing the thrust is a power supply having a largest capacity within the Hall thruster system.

The cathode gas flow rate controller 8 for supplying gas to the hollow cathode device 21, the heater power supply 6 for heating a cathode of the hollow cathode device 21, and the keeper power supply 7 for maintaining a steady electron flow from the hollow cathode device 21 together control the hollow cathode device 21 which serves as an electron source.

The control unit 9 for driving the Hall thruster 11 is controlled by commands from the artificial satellite (not shown) on which the Hall thruster 11 is mounted or from the ground. In this embodiment, at least the anode power supply 2, the coil power supplies 3, 4 and the gas flow rate controller 5 are controlled by the control unit 9.

A phenomenon known as discharge oscillation occasionally takes place while the Hall thruster 11 is in operation. It is difficult to say under which conditions the Hall thruster 11 exhibits the discharge oscillation phenomenon. Rather, discharge oscillations can occur due to various causes, such as the geometrical structure of the Hall thruster 11, magnetic field distribution and anode voltage. The anode voltage Va, the gas flow rate Q and the coil current Ic are only parameters which can be externally controlled during operation of the Hall thruster 11. Driving conditions of the hollow cathode device 21 are not so affected by the discharge oscillation phenomenon.

Figure 3A:
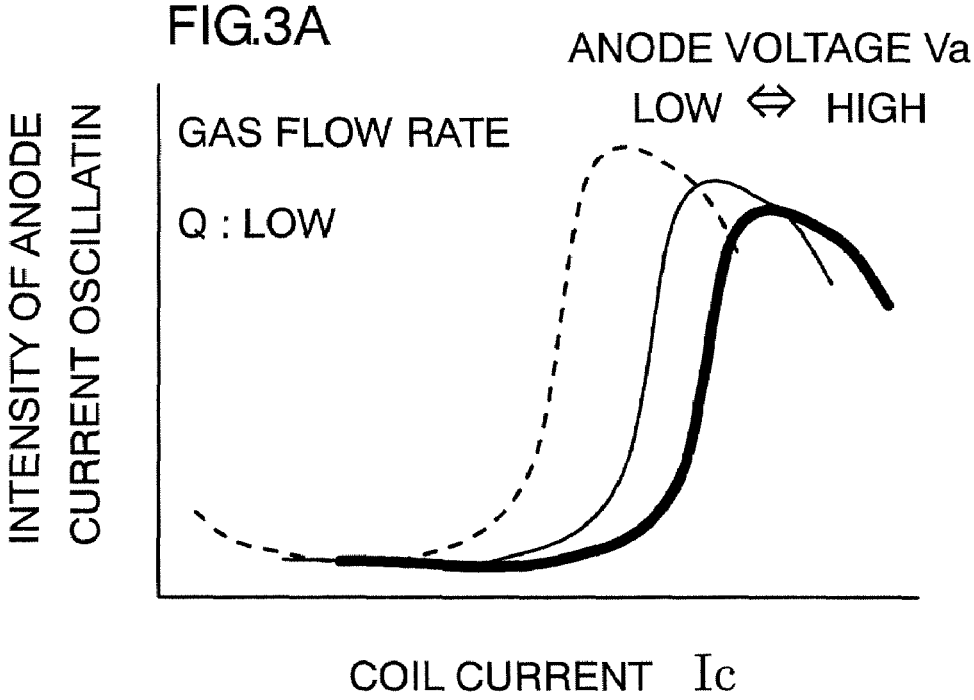
FIGS. 3A and 3B are graphs showing dependence of the intensity of oscillation of anode current on three parameters, that is, anode voltage Va, gas flow rate Q and coil current Ic according to the first embodiment of the invention.
Figure 3B:
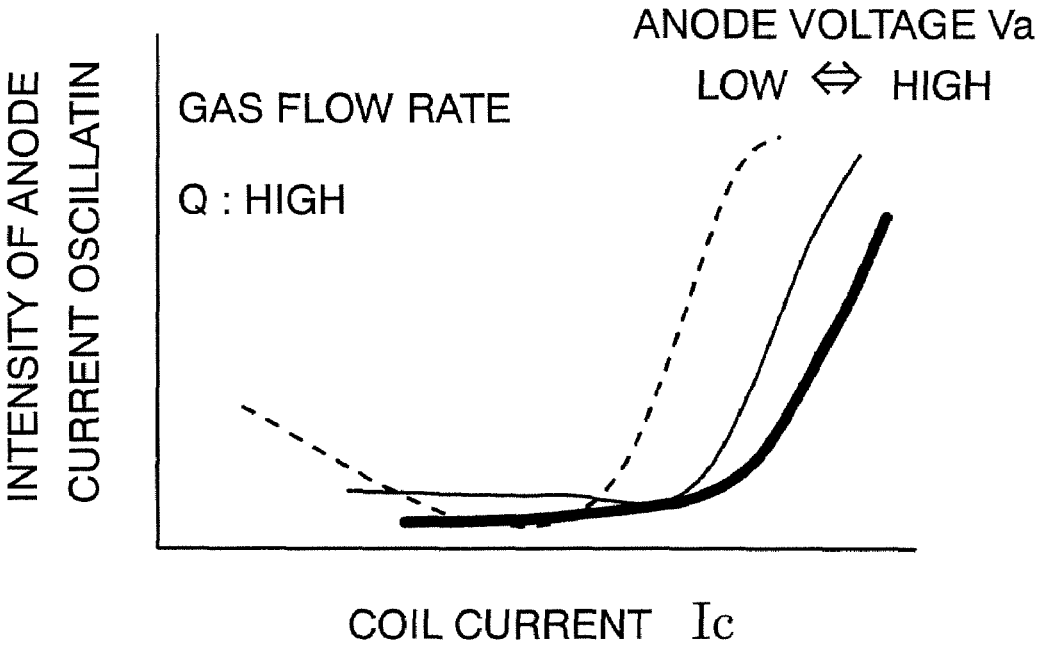

FIGS. 3A and 3B are diagrams schematically showing results of an experiment conducted to examine dependence of the intensity of oscillation of anode current on the aforementioned three parameters, that is, the anode voltage Va, the gas flow rate Q and the coil current Ic. The intensity of the discharge oscillation can be determined from the intensity of the anode current oscillation. In FIGS. 3A and 3B, the horizontal axis represents the coil current Ic and the vertical axis represents the intensity of the anode current oscillation. More specifically, FIG. 3A shows a relationship between the coil current Ic and the intensity of the anode current oscillation when the gas flow rate Q is low, and FIG. 3B shows a relationship between the coil current Ic and the intensity of the anode current oscillation when the gas flow rate Q is high. It can be seen from FIGS. 3A and 3B that the intensity of the anode current oscillation depends on all of the anode voltage Va, the gas flow rate Q and the coil current Ic. Therefore, the intensity of the anode current oscillation can be related to a function containing the three parameters. Thus the intensity of the discharge oscillation can be related to a function containing the three parameters, that is, the anode voltage Va, the gas flow rate Q and the coil current Ic.

The foregoing discussion suggests that it is possible to experimentally produce a database storing information on what values of the anode voltage Va, the gas flow rate Q and the coil current Ic would reduce the intensity of the anode current oscillation. Thus, it is possible to obtain a function related to the anode voltage Va and the coil current Ic applicable to suppressing oscillations of the anode current which corresponds to the magnitude of ion acceleration, that is, an output of the ion accelerator. The control unit 9 can suppress the oscillation of the anode current by controlling the anode voltage Va, the gas flow rate Q and the coil current Ic according to the quantity expressed by the function thus obtained. This means that it is possible to prevent the oscillation of the anode current by regulating the anode voltage Va, the gas flow rate Q and the coil current Ic.

The anode voltage Va and the gas flow rate Q are particularly important parameters determining the thrust of the Hall thruster 11. The anode voltage Va and the gas flow rate Q are often set to predetermined values in a case where the Hall thruster 11 is operated in a steady state to produce a specified amount of thrust. In contrast, the value of the coil current Ic can be freely determined within a specific range. In addition, although a certain amount of time is required for the gas flow rate Q to reach a set value, the coil current Ic relatively easily follows a set value. Thus, if the values of the gas flow rate Q and the coil current Ic are to be regulated according to externally input control commands, it is desirable to set the coil current Ic based on a comparison of a combination of command values with values stored in a database.

Sets of values of the three parameters, or the anode voltage Va, the gas flow rate Q and the coil current Ic, which are unlikely to produce the discharge oscillation are explained in the following. It is possible to construct a database on the sets of values of the anode voltage Va, the gas flow rate Q and the coil current Ic which are unlikely to produce the discharge oscillation by carrying out an experiment to measure the intensity of the anode current oscillation while varying the values of the three parameters over entire variable ranges thereof. Upon selecting a set of values of the three parameters which are unlikely to produce the discharge oscillation from the database, the power supply apparatus 1 drives the Hall thruster 11 in a controlled fashion based on the selected set of values of the three parameters. If the values of the anode voltage Va and the gas flow rate Q vary due to transient behavior, it is possible to determine to which value the coil current Ic should be varied with reference to the database. Theoretically, the Hall thruster 11 can be controlled by use of a database in this way.

In practice, however, it is necessary to conduct an experiment for measuring the intensity of the anode current oscillation while varying the values of the three parameters over the entire variable ranges thereof in order to construct such a database. Additionally, even if a database containing the values of the intensity of the anode current oscillation related to the values of the three parameters over the entire variable ranges thereof is produced, it is uncertain whether a value of the coil current Ic which suppresses the anode current oscillation exists within the entire variable ranges of the anode voltage Va and the gas flow rate Q. Thus, it is essential to formulate conditions under which the anode current oscillation occurs according to a physical principle and to establish a control method based on such formulation.

Inequality (22) shown in the earlier-mentioned non-patent document entitled "Discharge Current Oscillation in Hall Thrusters" formulates the conditions under which the discharge oscillation occurs. According to this non-patent document, conditions for preventing the discharge oscillation phenomenon can be expressed by inequality (1) below:

$$(V_{ea}-V_{ex})>k_i\overline{N_n}L \tag{1}$$

where $k_i$ is ionization frequency, $\overline{N_n}$ is neutral atom density and L is a typical axial length of an ionization zone. As shown in FIG. 1, the Hall thruster 11 is typically designed such that the magnetic flux density is maximized at the ion exit. Thus, the ionization zone is located near the ion exit of the Hall thruster 11. $V_{ea}$ in inequality (1) above is electron velocity in a plane intersecting the ionization zone on the anode side, and $V_{ex}$ is electron velocity in a plane intersecting the ionization zone on ion exit side.

From equation (10) shown in the aforementioned non-patent document, electron velocity $V_e$ can be expressed by equation (2) below using electron mobility μ:

$$V_e = \mu E + \frac{D}{N_e}\nabla N_e = \mu\left(E + \frac{K_B T_e}{q_e}\frac{\nabla N_e}{N_e}\right) \tag{2}$$

where E is electric field strength, D is diffusion coefficient, $N_e$ is electron density, $k_B$ is the Boltzmann's constant, $T_e$ is electron temperature and $q_e$ is electron charge.

When the effect of electron diffusion represented by a second term of a right side of equation (2) is disregarded, only a first term representing a drift of the electrons caused by an electric field is left on the right side. Assuming that the electron mobility comes from classical diffusion, the electron mobility can be expressed by equation (3) below:

$$\mu_c = \frac{m\nu}{q_e B^2} = \frac{mk_m}{q_e B^2}N_n \tag{3}$$

where B is magnetic flux density, $\nu=k_m N_n$ is electron collision frequency and $N_n$ is gas density.

Here, it is assumed that the magnetic flux density B is proportional to the coil current Ic, and the gas density $N_n$ is proportional to the gas flow rate Q and inversely proportional to cross-sectional area S of the ion exit of the Hall thruster 11 which is the ion accelerator. The cross-sectional area S of the ion exit is the area of a ringlike region bounded by an outer periphery of the inner ring 16 and an inner periphery of the outer ring 17 shown in the sectional diagram of FIG. 2. As the electric field strength E intensifies in a region where the magnetic flux density B increases in the Hall thruster 11, the electric field strength E is dependent on the distribution of the magnetic flux density B in the axial direction of the Hall thruster 11 (indicated by "z" in FIG. 1). Actually, magnetic flux densities are distributed in an axial direction which corresponds to an ion acceleration direction of the ion accelerator as well as in radial directions which are perpendicular to the axial direction.

Expressing the distribution of a radial component of the magnetic flux density along the axial direction z by B(z) and a radial component of the magnetic flux density at the ion exit by B, B(z) is typically so distributed that the magnetic flux density B is maximized at the ion exit as already mentioned with reference to FIG. 1. For this reason, a plasma is mostly intensely produced generally in the proximity of the ion exit and, thus, "B" may be regarded as a typical value of the magnetic flux density. It is possible to define a magnetic flux bias ratio β representing the ratio of the magnetic flux density at the ion exit to a mean value of magnetic flux densities distributed along the axial direction, or the ion acceleration direction, as indicated by equation (4) below:

$$\beta = \frac{B}{\frac{1}{d}\int_{Anode}^{Exit} B(z)dz} \tag{4}$$

where d is ion acceleration zone length, or the length of the ion acceleration zone 18 of the Hall thruster 11 which is the ion accelerator. More specifically, the ion acceleration zone length d is the length from the anode 12 to the ion exit of the Hall thruster 11 and an integral contained in equation (4) above represents the result of integration of B(z) over the axial length from the anode 12 to the ion exit. The magnetic flux bias ratio β, the ion acceleration zone length d and the cross-sectional area S of the ion exit are parameters which are dependent on the shape and design of the Hall thruster 11. Provided that the hollow cathode device 21 constituting a cathode is located at a position sufficiently close to the ion exit, it is possible to approximate electric field strength $E_x$ at the ion exit by equation (5) below using the magnetic flux bias ratio β:

$$E_x = \frac{\beta \cdot V_a}{d} \tag{5}$$

From equations (2) and (5), electron velocity $V_{e_c}$ can be expressed by equation (6) below in the case of classical diffusion:

$$V_{e_c} \cong \mu_c E \propto \frac{\beta \cdot V_a \cdot Q}{d \cdot S \cdot B^2} \propto \frac{V_a \cdot Q}{I_c^2} \tag{6}$$

If the electron velocity exhibits dependence expressed by equation (6), the left side of inequality (1) should have similar dependence. It follows that the likelihood that the discharge oscillation will occur can be expressed in a simplified form as shown by the right side of equation (6). The inventors conducted an experiment to examine a relationship between $(\beta \times Va \times Q)/(d \times S \times B^2)$ and the intensity of the anode current oscillation using a relationship expressed by equation (6).

Figure 4:
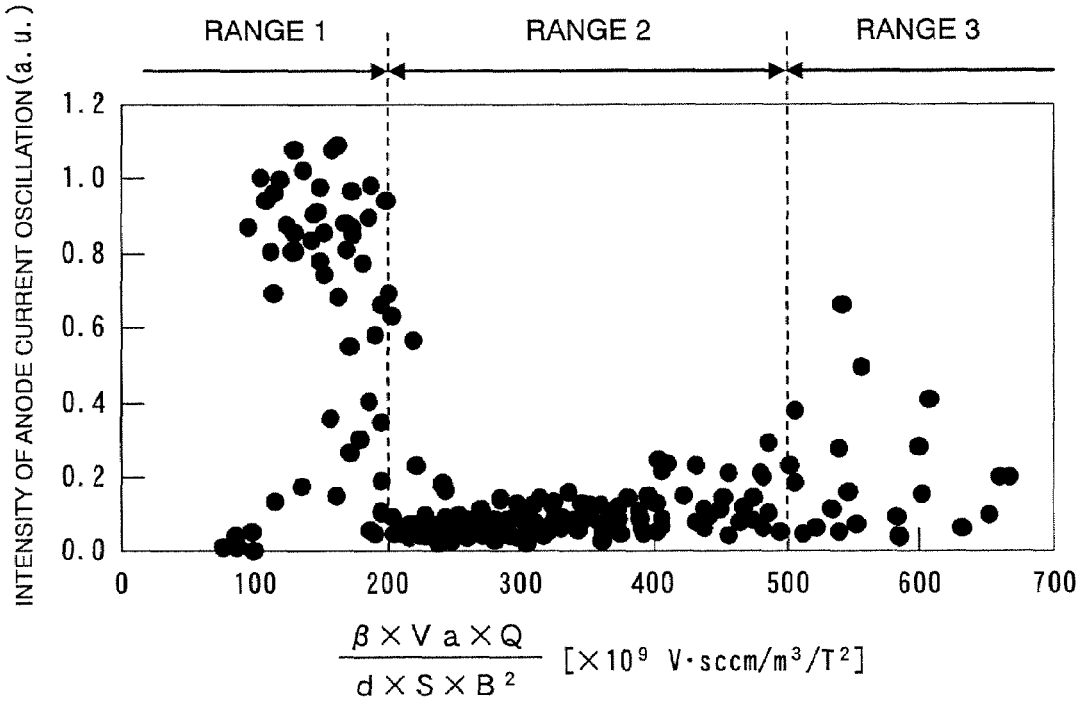
FIG. 4 is a graph showing the intensity of the anode current oscillation according to the first embodiment of the invention.

FIG. 4 is a graph showing experimental results with respect to the intensity of the anode current oscillation according to the first embodiment of the invention, in which the horizontal axis represents $(\beta \times Va \times Q)/(d \times S \times B^2)$ and the vertical axis represents the normalized intensity of the anode current oscillation which is obtained by dividing the original intensity of the anode current oscillation by a mean value (DC component) of the anode current. Small dots shown in FIG. 4 are plots of measurements of the intensity of the anode current oscillation versus values of $(\beta \times Va \times Q)/(d \times S \times B^2)$ obtained with various combinations of the anode voltage Va (V), the gas flow rate Q (sccm) and the magnetic flux density B (T) which is proportional to the coil current Ic, where "sccm" used as a unit of the gas flow rate Q stands for "standard cubic centimeters per minute." The intensity of the anode current oscillation can be defined in terms of the amplitude of the anode current oscillation. The gas used as a propellant of the Hall thruster 11 in the experiment was xenon (Xe). The magnetic flux density has different values at different parts of the ion acceleration zone 18. In this embodiment, the magnetic flux density B (T) represents the value of the magnetic flux density at the ion exit of the Hall thruster 11. Also, the cross-sectional area of the ion exit is S ($m^2$), the ion acceleration zone length is d (m) and the magnetic flux bias ratio is β in the Hall thruster 11 of the present embodiment.

It can be seen from FIG. 4 that almost all the plots of the measurements of the intensity of the anode current oscillation lie along a single curve when the experimental results are plotted in relation to $(\beta \times Va \times Q)/(d \times S \times B^2)$ represented by the horizontal axis according to equation (6) which is normalized based on the classical diffusion. As depicted in FIG. 4, range 1 of $(\beta \times Va \times Q)/(d \times S \times B^2)$ is where extremely intense anode current oscillations occur. In contrast, range 2 of $(\beta \times Va \times Q)/(d \times S \times B^2)$ shown in FIG. 4 is where the anode current oscillation is suppressed and the Hall thruster 11 operates in a stable fashion. This indicates that it is desirable to use range 2 as a working range of the Hall thruster 11. In range 3 of $(\beta \times Va \times Q)/(d \times S \times B^2)$ shown in FIG. 4, the anode current oscillation occurs at random. The magnetic field is relatively weak in range 3 and this range is separated from a typical working range of the Hall thruster 11 in which the Hall effect is strong enough. Thus, phenomena occurring in range 3 can not be explained by inequality (1) which is obtained through several approximations. This means that range 3 is not desirable for use as a working range of the Hall thruster 11 either.

A boundary between range 2 and range 3 is not as clear as a boundary between range 1 and range 2. For this reason, it is more appropriate to select range 2 as a control range as range 2 is nearer to the boundary between range 1 and range 2 where the left and right sides of inequality (1) are equal to each other. Depending on the structure and type of the Hall thruster 11, range 2 may become extremely narrow. Thus, when the anode current is apt to oscillate, control based on the relationship graphed in FIG. 4 would work effectively.

It is understood from the foregoing discussion that combinations of the anode voltage Va, the gas flow rate Q and the magnetic flux density B which is proportional to the coil current Ic should be selected such that the values of $(\beta \times Va \times Q)/(d \times S \times B^2)$ fall within range 2. More specifically, when xenon is used as the propellant, combinations of the anode voltage Va, the gas flow rate Q and the magnetic flux density B which is proportional to the coil current Ic should be selected such that the values of $(\beta \times Va \times Q)/(d \times S \times B^2)$ fall within a range of $200 \times 10^9$ to $500 \times 10^9$, or such that the value of $(\beta \times Va \times Q)/(d \times S \times B^2)$ which is a function of the anode voltage Va and the magnetic flux density B (thus, the coil current Ic) would satisfy a relationship expressed by inequality (7) below:

$$200\times10^9 < \frac{\beta\cdot V_a\cdot Q}{d\cdot S\cdot B^2} < 500\times10^9 \quad (7)$$

In the Hall thruster 11 thus structured, the control unit 9 controls the anode voltage Va, the gas flow rate Q and the magnetic flux density B at the ion exit which is dependent on the coil current Ic such that inequality (7) above expressed by the function related to the anode voltage Va and the coil current Ic is satisfied, wherein inequality (7) contains as variables the cross-sectional area S of the ion exit of the Hall thruster 11 (ion accelerator), the ion acceleration zone length d of the ion accelerator and the magnetic flux bias ratio β which is the ratio of the magnetic flux density B at the ion exit to the mean value of the magnetic flux densities along the ion acceleration direction of the ion accelerator. The control unit 9 serves to prevent the occurrence of the discharge oscillation in this fashion. It has become apparent from the aforementioned consideration that the discharge oscillation can be suppressed if the Hall thruster 11 is operated under conditions where the values of $(\beta\times Va\times Q)/(d\times S\times B^2)$ fall within a specified range.

It is to be noted that the values shown in inequality (7) above defining the range of $(\beta\times Va\times Q)/(d\times S\times B^2)$ are applicable to a case where xenon is used as the propellant. It is expected that threshold values of $(\beta\times Va\times Q)/(d\times S\times B^2)$ differ from those shown in inequality (7) if krypton (Kr) or argon (Ar), for instance, is used as the propellant. Even if the threshold values vary, however, it is possible in principle to prevent the discharge oscillation if the Hall thruster 11 is operated under conditions where the values of $(\beta\times Va\times Q)/(d\times S\times B^2)$ fall within a specified range.

Generally, the magnetic flux density depends on the coil current Ic. While the magnetic flux density is approximately proportional to the coil current Ic in a low magnetic flux density area, the magnetic flux density tends to become saturated regardless of the coil current Ic when the magnetic flux density increases. Therefore, in a low magnetic flux density area in which the magnetic flux density is not saturated, it is appropriate to select $Va\times Q/Ic^2$ containing externally controllable parameters as an index for control. This idea is not only backed by an obvious theoretical support but provides clear guidelines with respect to how the occurrence of the discharge oscillation can be avoided. In short, it is possible to prevent the discharge oscillation if the value of $Va\times Q/Ic^2$ is held within a specified range or, in other words, if the value of the coil current Ic is kept approximately proportional to a value obtained by multiplying the root of the anode voltage Va by the root of the gas flow rate Q according to the function related to the anode voltage Va and the coil current Ic.

It should be pointed out that the aforementioned relationship among the parameters is based on a plurality of approximations. It has been verified from the experimental results that the magnetic flux is not so exactly proportional to the coil current Ic. Since the magnetic flux has a particular distribution pattern within the Hall thruster 11 and is strongly affected by the structure of the Hall thruster 11, it is difficult to clearly express the relationship between the magnetic flux and the coil current Ic. The proportionality between the gas flow rate Q and the gas density is also a result of several approximations. In particular, because this proportionality is based on the assumption that gas velocity (gas temperature) within the Hall thruster 11 is approximately constant, it is not necessarily assured that the gas flow rate Q and the gas density are proportional to each other. In addition, the gas density has some form of spatial distribution and it is difficult to experimentally determine the spatial distribution of the gas density. The proportionality between the gas flow rate Q and the gas density is not assured from this point of view either. Furthermore, the anode voltage Va and the electric field strength E are not related to each other in a manner that assures exact proportionality between the distribution of the magnetic flux and that of the electric field strength as mentioned earlier.

As discussed in the foregoing, equation (6) is an approximated expression used for convenience. To obtain a solution close to what will be derived from theoretical equation (3), it is preferable to use $E\times N_n/B^2$, and not $Va\times Q/Ic^2$, as an index for control. It is not so easy to control the electric field strength E, the gas density $N_n$ and the magnetic flux density B because these parameters have spatial distributions. However, if the electric field strength E, the gas density $N_n$ and the magnetic flux density B can be more exactly related to the anode voltage Va, the gas flow rate Q and the coil current Ic, it should be possible to operate the Hall thruster 11 more accurately by controlling the individual parameters according to the value of $E\times N_n/B^2$.

Equation (6) is applicable only to the boundary between range 1 and range 2 shown in FIG. 4, and the above-described theory can not be applied to range 3. Thus, experimental results concerning the discharge oscillation phenomenon are required in order to obtain a clearly defined equation applicable to range 3. It is therefore preferable to control the Hall thruster 11 using a combination of a method of controlling the Hall thruster 11 according to equation (6) and a method of controlling the Hall thruster 11 based on a database derived from the experimental results.

The occurrence of the discharge oscillation in the Hall thruster 11 depends on the anode voltage Va, the magnetic flux density B and the gas density which is dependent on the gas flow rate Q as described above. Therefore, it is possible to eliminate a working range in which the Hall thruster 11 exhibits an unstable behavior by controlling the Hall thruster 11 such that the aforementioned parameters vary in a correlated manner. Additionally, the inventors have found that the occurrence of the discharge oscillation is dependent on the quantity expressed by a function expressed by $Va\times Q/Ic^2$.

As thus far discussed, the control unit 9 controls the Hall thruster 11 such that the coil current Ic is kept approximately proportional to the value obtained by multiplying the root of the anode voltage Va by the root of the gas flow rate Q. In this embodiment, the anode voltage Va, the gas flow rate Q and the coil current Ic are controlled according to the quantity expressed by the function related to the anode voltage Va and the coil current Ic. As the control unit 9 controls the Hall thruster 11 in the aforementioned manner, the power supply apparatus 1 of the embodiment can operate the Hall thruster 11 (ion accelerator) in a stable fashion while preventing the occurrence of the discharge oscillation in every operating range of the Hall thruster 11.

Second Embodiment

While the control unit 9 controls the Hall thruster 11 such that the coil current Ic becomes approximately proportional to the root of the anode voltage Va in the foregoing first embodiment, the control unit 9 controls the Hall thruster 11 such that the coil current Ic becomes approximately proportional to the anode voltage Va in a second embodiment of the invention. Generally, the electron velocity within the Hall thruster 11 is determined by classical diffusion in a region of low magnetic flux density and by anomalous diffusion (Bohm diffusion) in a region of high magnetic flux density. When the anomalous diffusion is dominant, the electron mobility and electron velocity can be expressed by equations (8) and (9) below, respectively:

$$\mu_a = \frac{1}{16B} \tag{8}$$

$$V_{e_a} \cong \mu_a E \propto (\beta \times Va)/(d \times B) \propto \frac{V_a}{I_c} \tag{9}$$

As compared to equation (6), equation (9) contains (β×Va)/(d×B) and Va/Ic, either of which may be used as a parameter on which the discharge oscillation is dependent. Even when the experimental results shown in FIG. 4 are plotted on a graph whose horizontal axis represents (β×Va)/(d×B), however, the graph thus produced shows no evident tendency for the discharge oscillation to decrease in any particular pattern. This fact indicates that the experimental results plotted in range 2 of FIG. 4 can be regarded as data for a region dominated by the classical diffusion. Therefore, it is appropriate to control the Hall thruster 11 such that values of Va/Ic fall within a specified range or, in other words, such that the coil current Ic is kept approximately proportional to the anode voltage Va according to a function related to the anode voltage Va and the coil current Ic in a region in which the anomalous diffusion is dominant and the magnetic flux density B increases.

Since the Hall thruster 11 is controlled such that the coil current Ic remains approximately proportional to the anode voltage Va as mentioned above, it is possible to reduce the discharge oscillation even in the region in which the magnetic flux density B increases according to the present embodiment.

Third Embodiment

It is possible to operate the Hall thruster 11 in a stable state in which the discharge oscillation is unlikely to occur by controlling the Hall thruster 11 in the manner described earlier with reference to the first embodiment. Specifically, the Hall thruster 11 can be operated in a stable fashion in every operating range if appropriate values of the coil current Ic are selected in accordance with any given values of the anode voltage Va and the gas flow rate Q. It is not only important to operate the Hall thruster 11 in this way when the Hall thruster 11 is under steady-state operating conditions; it is also extremely effective to operate the Hall thruster 11 in aforementioned way for making the discharge oscillation less likely to occur to achieve improved operational stability of the Hall thruster 11 especially when the anode voltage Va rises during thruster startup or when the Hall thruster 11 is under transient conditions where the anode voltage Va and the gas flow rate Q are varied for altering the magnitude of ion acceleration to make a change in the thrust produced by the Hall thruster 11, for instance.

Figure 5A:
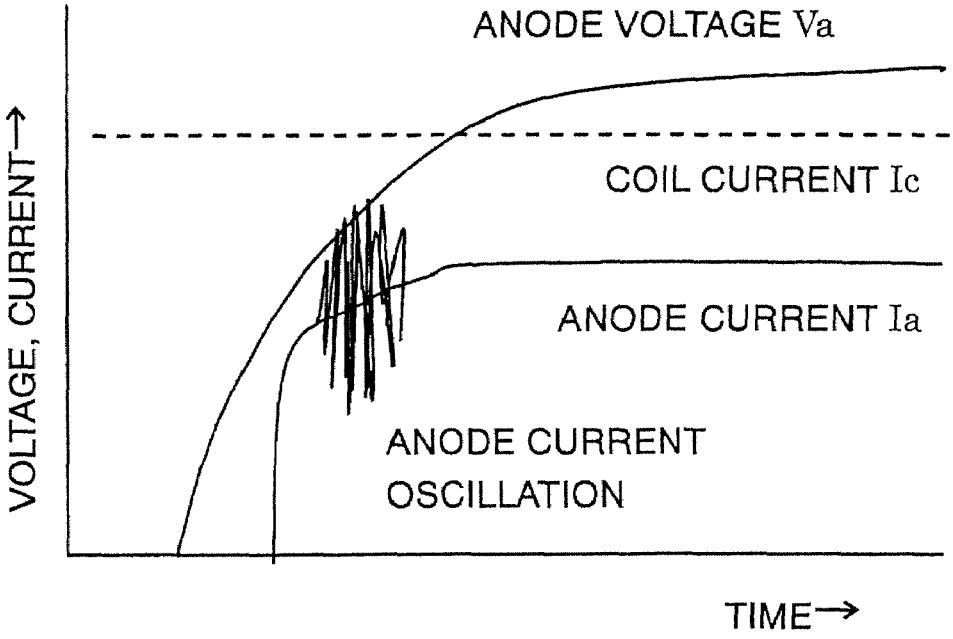
FIGS. 5A, 5B and 5C are graphs showing waveforms of the anode voltage Va and anode current Ia in relation to the coil current Ic observed during thruster startup.
Figure 5B:
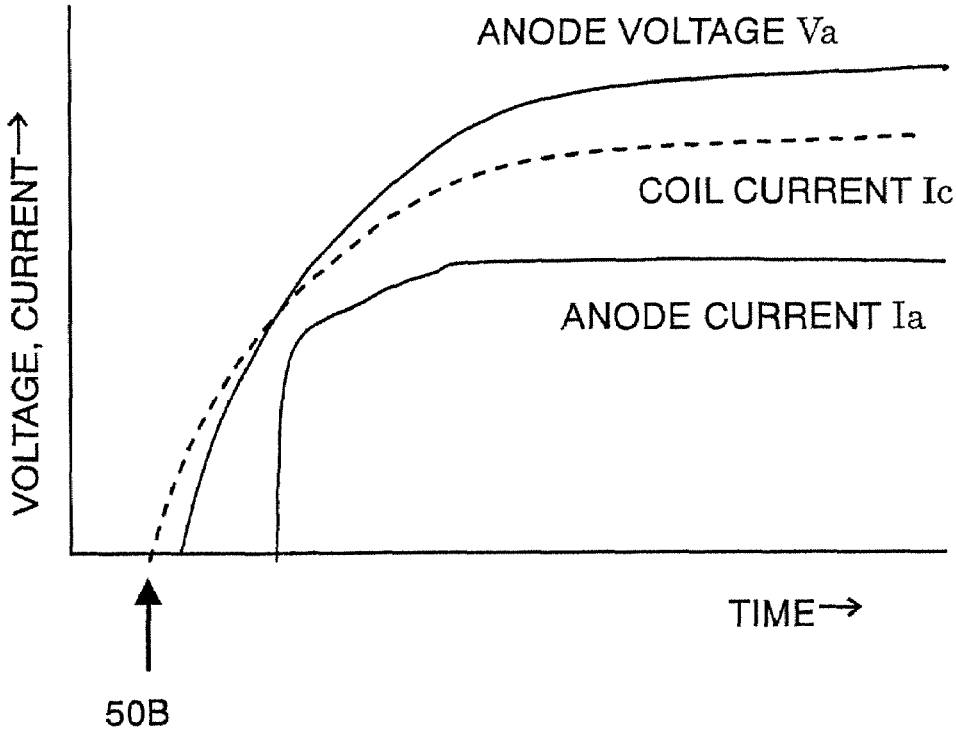
Figure 5C:
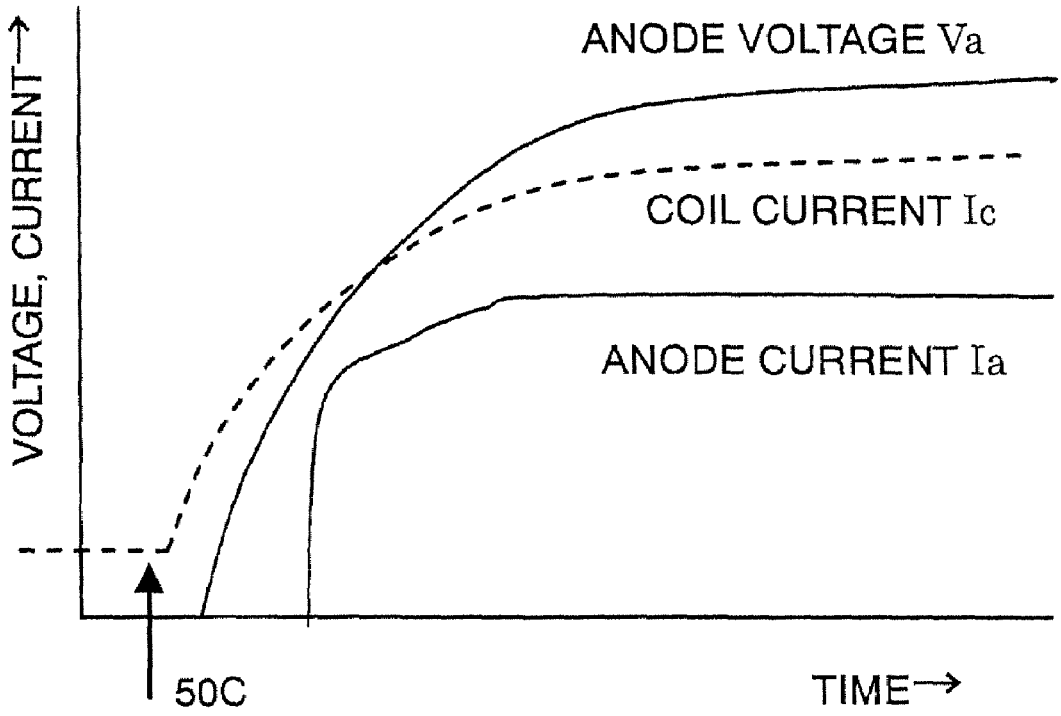

FIGS. 5A, 5B and 5C are diagrams showing waveforms of the anode voltage Va and anode current Ia in relation to the coil current Ic observed during thruster startup when the Hall thruster 11 begins to produce a plasma discharge, in which the horizontal axis represents time and the vertical axis represents both voltage and current. If the anode voltage Va of a particular level is abruptly applied, an intense rush current will occur during the thruster startup. For this reason, the anode voltage Va is gradually increased with a time constant of the order of several milliseconds. In this embodiment, the Hall thruster 11 is controlled based on the assumption that the gas flow rate Q can not be rapid regulated and, therefore, the propellant gas is flowed at a specific rate before application of the anode voltage Va.

FIG. 5A shows the waveforms of the anode voltage Va and the anode current Ia observed when the coil current Ic is flowed at a specific level before application of the anode voltage Va. Since the gas flow rate Q and the coil current Ic are maintained at the specific level, only the anode voltage Va varies before and after the application of the anode voltage Va in this case. Thus, conditions of range 1 shown in FIG. 4 explained in the first embodiment occur, developing the discharge oscillation phenomenon, during a process in which the anode voltage Va varies from an initial level to a stable level, especially when the anode voltage Va is low. The occurrence of the discharge oscillation poses a serious problem for the operational stability of the Hall thruster 11.

In contrast, it is possible to avoid the discharge oscillation problem if the Hall thruster 11 is controlled as depicted in FIG. 5B. In the case of FIG. 5B, the coil current Ic gradually increases as the anode voltage Va is increased up to a point where the anode voltage Va stabilizes after the application thereof. When the Hall thruster 11 is to be controlled according to the value of $Va \times Q/Ic^2$ which is a function related to the anode voltage Va and the coil current Ic, the coil current Ic is controlled such that the coil current Ic remains approximately proportional to the root of the anode voltage Va considering that the gas flow rate Q is held constant. In other words, the control unit 9 controls the Hall thruster 11 such that the coil current Ic is kept approximately proportional to the value obtained by multiplying the root of the anode voltage Va by the root of the gas flow rate Q in this case. When the Hall thruster 11 is to be controlled according to the value of Va/Ic which is another function related to the anode voltage Va and the coil current Ic, the control unit 9 controls the Hall thruster 11 such that the coil current Ic is kept proportional to the anode voltage Va. It is possible to prevent the occurrence of the discharge oscillation from a point of thruster startup to a point of steady-state operation, thereby ensuring stable initialization of the Hall thruster 11, by controlling the Hall thruster 11 such that the coil current Ic gradually increases as the anode voltage Va is increased as discussed above.

If the value of the coil current Ic is large and the magnetic flux density B is considerably high at the thruster startup when the Hall thruster 11 should begin to produce a plasma discharge, the Hall effect makes it difficult for the Hall thruster 11 to produce the plasma discharge. For this reason as well, it is preferable to set the coil current Ic to a relatively low level at a point of plasma discharge initiation. The anode voltage Va is controlled to gradually increase by properly adjusting a time constant of an internal CR circuit of the anode power supply 2 or by setting an internal voltage control circuit of the anode power supply 2, for example. With this arrangement, the coil current Ic is caused to gradually increase with a gradual increase in the anode voltage Va. The coil current Ic can be caused to gradually increase by an internal circuit configuration of the inner and outer coil power supplies 3, 4 or by setting the coil current Ic to increase in a steplike fashion. Since there is certain tolerance for the range of stable operation where the anode current oscillation is unlikely to occur as depicted in FIG. 4, the coil current Ic should be so adjusted that operating conditions of the Hall thruster 11 fall within this range.

In order to vary the coil current Ic with the anode voltage Va during startup of the Hall thruster 11, it is essential to cause the coil current Ic to begin flowing at the same time when or before the anode voltage Va is applied. Thus, the control unit 9 controls the Hall thruster 11 such that the coil current Ic to begin to flow prior to application of the anode voltage Va as shown by an arrow 50B in FIG. 5B. If the anode voltage Va is applied under conditions where the coil current Ic is not flowing, or where magnetic flux is not produced in the Hall thruster 11, there is produced no magnetic field which slows down the electron velocity, so that an electric arc is produced between the cathode and the anode 12, resulting in a short circuit between the electrodes. Should such a situation occur, a great amount of current flows within the Hall thruster 11, potentially causing a thruster breakdown.

In a case where the coil current Ic is caused to begin flowing prior to the application of the anode voltage Va, it is impossible to apply the aforementioned function which indicates that the coil current Ic is proportional to the value obtained by multiplying the root of the anode voltage Va by the root of the gas flow rate Q at least at the moment when the anode voltage Va is rising. Taking into consideration the fact that the anode voltage Va rises from zero level, it is certain that the Hall thruster 11 goes through range 1 shown in FIG. 4 in a region where the anode voltage Va is sufficiently low. Nonetheless, as can be seen from FIG. 5B, the anode current begins to flow after the anode voltage Va has reached to a particular level.

Since the plasma discharge does not occur in the Hall thruster 11 until the anode voltage Va reaches this particular level, the anode current does not flow while the anode voltage Va is too low. It follows that unstable discharge oscillations do never occur in a stage in which the plasma discharge has not been initiated. Therefore, the discharge oscillation problem does not occur even under the aforementioned conditions of range 1 depicted in FIG. 4 when the anode voltage Va is not higher than a specific level.

Additionally, the coil current Ic needs to be kept approximately proportional to the value obtained by multiplying the root of the anode voltage Va by the root of the gas flow rate Q, or simply to the anode voltage Va, as stated earlier. This means that it is not necessary to maintain the coil current Ic strictly proportional to those quantities and, thus, there is some tolerance for conditions under which the discharge oscillation is unlikely to occur as shown by range 1 of FIG. 4. It is so difficult to control the coil current Ic at a rising edge thereof that the coil current Ic need not be maintained strictly proportional to the value obtained by multiplying the root of the anode voltage Va by the root of the gas flow rate Q during the thruster startup. Rather, the Hall thruster 11 should be controlled within a range of tolerance limits as shown by range 1 of FIG. 4 so that the coil current Ic is kept approximately proportional to the value obtained by multiplying the root of the anode voltage Va by the root of the gas flow rate Q from a practical point of view.

If power loss does not pose any substantial problem, a small amount of coil current Ic may be kept flowing in advance to constantly generate a weak magnetic field as shown by an arrow 50C in FIG. 5C.

The anode voltage Va greatly varies in level during the thruster startup when the Hall thruster 11 begins to produce the plasma discharge as stated above. Thus, as the anode voltage Va increases the during thruster startup, the Hall thruster 11 goes through a range in which the discharge oscillation may become intense, resulting unstable thruster operation. If the coil current Ic and the anode voltage Va are simultaneously varied such that the value of $Va \times Q/Ic^2$ is held within a specified range with the gas flow rate Q held constant, it is possible to achieve greatly improved stability of the Hall thruster 11 during startup. Additionally, since the plasma discharge begins when the coil current Ic is relatively small, the Hall thruster 11 is not so susceptible to the influence of the Hall effect that the Hall thruster 11 can initiate the plasma discharge in a reliable fashion. Furthermore, the gas flow rate Q does not vary so quickly that the anode voltage Va is applied after the Hall thruster 11 has begun to flow the propellant gas through the discharge channel. As the coil current Ic is increased almost simultaneously with the anode voltage Va, it is possible to prevent the anode current from becoming unstable when the anode voltage Va is rising.

As thus far described, the control unit 9 begins to flow the coil current Ic prior to application of the anode voltage Va at startup of the Hall thruster 11 (ion accelerator) in the present embodiment. The control unit 9 controls the Hall thruster 11 such that the coil current Ic remains approximately proportional to the value obtained by multiplying the root of the anode voltage Va by the root of the gas flow rate Q, or simply to the anode voltage Va, until the anode voltage Va stabilizes after application thereof. As the control unit 9 controls the Hall thruster 11 in the aforementioned manner, the power supply apparatus 1 of the embodiment can operate the Hall thruster 11 (ion accelerator) in a stable fashion while preventing the occurrence of the discharge oscillation at startup of the Hall thruster 11.

Fourth Embodiment

Figure 6:
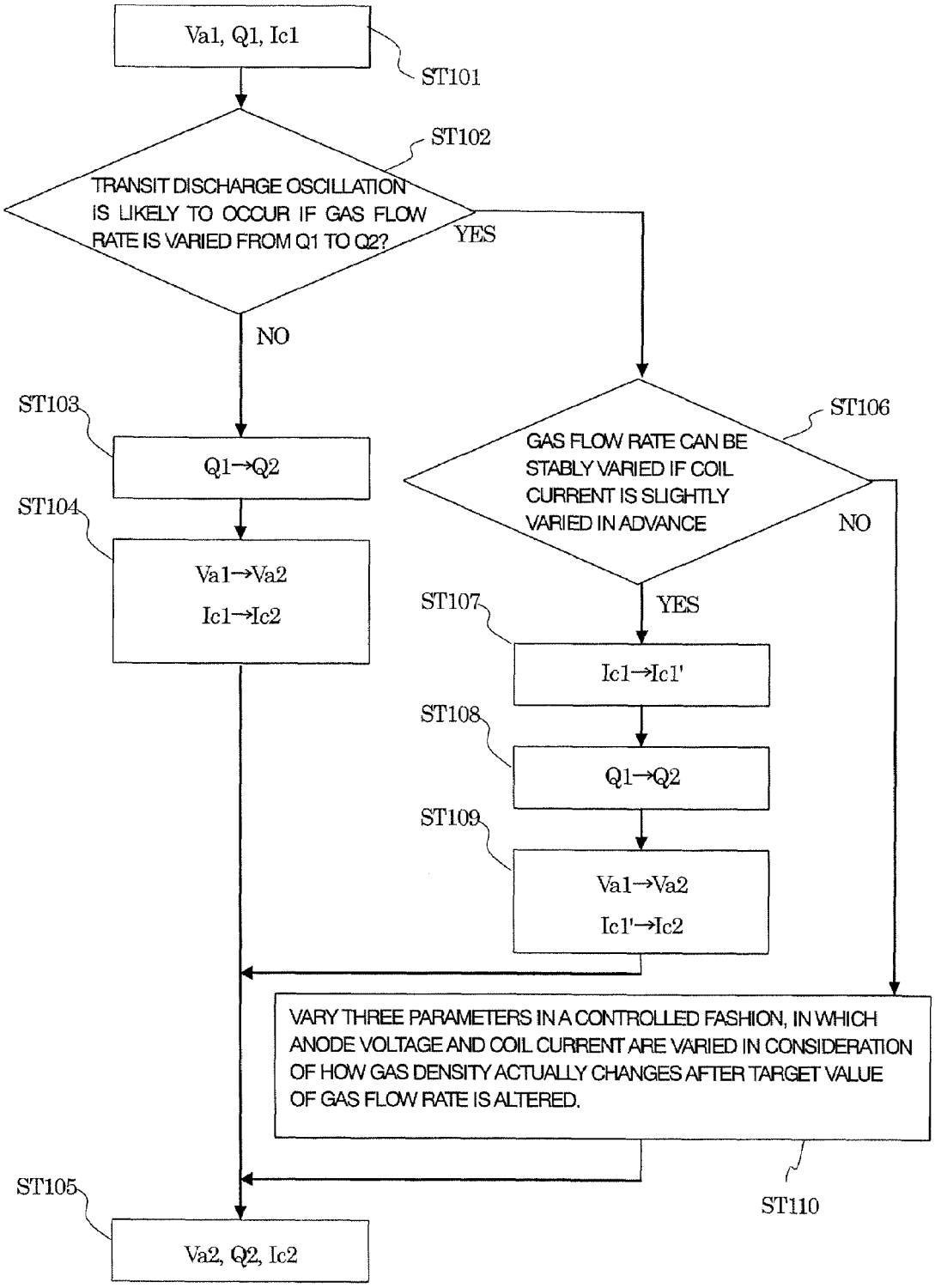
FIG. 6 is a flowchart showing a procedure for varying set values of the anode voltage Va, the gas flow rate Q and the coil current Ic for altering the magnitude of ion acceleration according to a fourth embodiment of the invention.

FIG. 6 is a flowchart showing a procedure for varying set values of the anode voltage Va, the gas flow rate Q and the coil current Ic for altering the magnitude of ion acceleration according to a fourth embodiment of the present invention. It is necessary to prevent the discharge oscillation by controlling the anode voltage Va, the gas flow rate Q and the coil current Ic in the manner described earlier with reference to the first embodiment also when altering the magnitude of ion acceleration for altering the thrust of the Hall thruster 11. When the set values of these parameters are varied, transient variations in the values of the parameters will result. The procedure of FIG. 6 focuses particularly on a case where the gas flow rate Q is varied. Compared to cases where electric quantities, such as the anode voltage Va and the coil current Ic, are varied, by far a longer period of time is required to vary the value of the gas flow rate Q.

As previously mentioned, the Hall thruster 11 must be operated under conditions where the relationship expressed by equation (6) or (9) is satisfied. When altering the magnitude of ion acceleration, it is necessary to determine whether the Hall thruster 11 is currently operated in a region to which the relationship expressed by equation (6) is applied or in a region to which the relationship expressed by equation (9) is applied. The coil current Ic must be varied such that the coil current Ic remains approximately proportional to the value obtained by multiplying the root of the anode voltage Va by the root of the gas flow rate Q in the region to which equation (6) for the classical diffusion is applied, whereas the coil current Ic must be varied such that the coil current Ic remains approximately proportional to the anode voltage Va in the region to which equation (9) for the anomalous diffusion is applied. The procedure of FIG. 6 is described below on the assumption that the Hall thruster 11 must be operated in this manner for altering the magnitude of ion acceleration in a stable fashion.

Shown in step ST101 is an initial condition in which the anode voltage is Va1, the gas flow rate is Q1 and the coil current is Ic1. In step ST102, the control unit 9 judges whether the discharge oscillation is likely to occur if only the gas flow rate is varied from Q1 to Q2. If the discharge oscillation is judged unlikely to occur (No in step ST102), the control unit 9 proceeds to step ST103 in which the gas flow rate controller 5 varies only the gas flow rate from Q1 to Q2. Upon confirming that the gas flow rate has stabilized at the aforementioned target value Q2, the control unit 9 proceeds to step ST104 in which the control unit 9 varies the anode voltage from Va1 to Va2 and the coil current from Ic1 to Ic2. If the Hall thruster 11 is in the classical diffusion region when the magnitude of ion acceleration is to be altered, the Hall thruster 11 is controlled such that the coil current Ic remains approximately proportional to the value obtained by multiplying the root of the anode voltage Va by the root of the gas flow rate Q. If the Hall thruster 11 is in the anomalous diffusion region when the magnitude of ion acceleration is to be altered, however, the Hall thruster 11 is controlled such that the coil current Ic remains approximately proportional to the anode voltage Va. Shown in step ST105 is a condition in which the anode voltage, the gas flow rate and the coil current have been varied to Va2, Q2, Ic2, respectively.

If the judgment result in step ST102 is in the affirmative indicating a possibility that the discharge oscillation may occur when the gas flow rate is varied from Q1 to Q2 (Yes in step ST102), the control unit 9 proceeds to step ST106 in which the control unit 9 judges whether the gas flow rate can be varied from Q1 to Q2 in a stable fashion regardless of the possibility of the occurrence of the discharge oscillation if the coil current Ic is varied by a small amount in advance. If the judgment result in step ST106 is in the affirmative indicating that the gas flow rate can be varied from Q1 to Q2 in a stable fashion (Yes in step ST106), the control unit 9 proceeds to step ST107 in which the control unit 9 slightly varies the coil current from Ic1 to Ic1'. In succeeding step ST108, the gas flow rate controller 5 varies the gas flow rate from Q1 to Q2. Upon confirming that the gas flow rate has stabilized at the aforementioned target value Q2, the control unit 9 proceeds to step ST109 in which the control unit 9 varies the anode voltage from Va1 to Va2 and the coil current from Ic1' to Ic2. If the Hall thruster 11 is in the classical diffusion region when the magnitude of ion acceleration is to be altered, the Hall thruster 11 is controlled such that the coil current Ic remains approximately proportional to the value obtained by multiplying the root of the anode voltage Va by the root of the gas flow rate Q. If the Hall thruster 11 is in the anomalous diffusion region when the magnitude of ion acceleration is to be altered, however, the Hall thruster 11 is controlled such that the coil current Ic remains approximately proportional to the anode voltage Va. Shown in step ST105 is a condition in which the anode voltage, the gas flow rate and the coil current have been varied to Va2, Q2, Ic2, respectively, in the aforementioned manner.

If the judgment result in step ST106 is in the negative indicating that the discharge oscillation is likely to occur even if the coil current Ic is varied by a small amount in advance (No in step ST106), the control unit 9 proceeds to step ST110 in which the control unit 9 varies one or both of the anode voltage Va and the coil current Ic while varying the gas flow rate Q at the same time. Although the gas flow rate Q can not be finely regulated with the lapse of time, the anode voltage Va and the coil current Ic which are electric quantities can be finely adjusted with time so easily.

In order to anticipate how the gas flow rate Q actually varies when the gas flow rate Q is altered based on a designated value given to the gas flow rate controller 5, it is necessary to predetermine a time constant of changes in the gas flow rate Q by conducting an experiment in advance, for instance. If the Hall thruster 11 is operated in the classical diffusion region, the control unit 9 varies the anode voltage Va and the coil current Ic in an electrically controlled fashion taking into account the time constant of changes in the gas flow rate Q such that the coil current Ic remains approximately proportional to the value obtained by multiplying the root of the anode voltage Va by the root of the gas flow rate Q. If the Hall thruster 11 is operated in the anomalous diffusion region, the control unit 9 varies the anode voltage Va and the coil current Ic in an electrically controlled fashion taking into account the time constant of changes in the gas flow rate Q such that the coil current Ic remains approximately proportional to the anode voltage Va.

It is possible to prevent the occurrence of the discharge oscillation by controlling the Hall thruster 11 in the aforementioned manner even when the gas flow rate Q is varied. After the gas flow rate has stabilized at the target value Q2, the control unit 9 varies the anode voltage Va and the coil current Ic to the aforementioned target values Va2 and Ic2, respectively. While the foregoing discussion has shown a case in which the gas flow rate Q is varied at first, the procedure of the fourth embodiment may be modified such that the anode voltage Va and the coil current Ic are varied simultaneously with the gas flow rate Q.

When the magnitude of ion acceleration is being altered, the control unit 9 controls the Hall thruster 11 such that the coil current Ic is kept approximately proportional to the value obtained by multiplying the root of the anode voltage Va by the root of the gas flow rate Q if the Hall thruster 11 is in the classical diffusion region, and such that the coil current Ic is kept approximately proportional to the anode voltage Va if the Hall thruster 11 is in the anomalous diffusion region as described above. As the control unit 9 controls the Hall thruster 11 in the aforementioned manner, the power supply apparatus 1 of the embodiment can operate the Hall thruster 11 (ion accelerator) in a stable fashion while preventing the occurrence of the discharge oscillation even when the magnitude of ion acceleration is altered.

Fifth Embodiment

Figure 7:
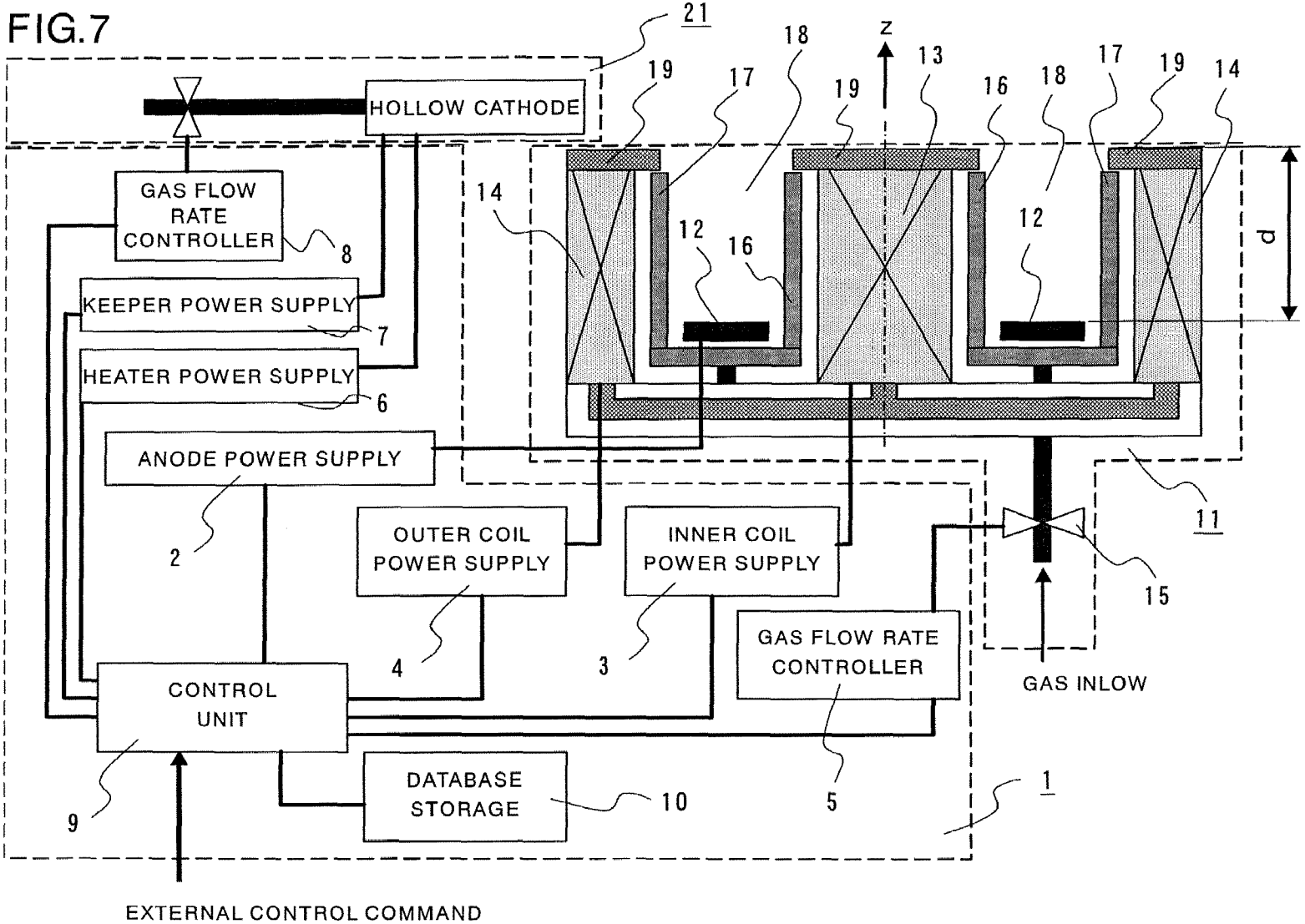
FIG. 7 is a configuration diagram of a power supply apparatus for a Hall thruster according to a fifth embodiment of the invention.

FIG. 7 is a configuration diagram of a power supply apparatus 1 according to a fifth embodiment for carrying out the present invention, in which elements identical or similar to those of the first embodiment are designated by the same reference numerals. The power supply apparatus 1 of the fifth embodiment includes, in addition to the aforementioned constituent elements of the first embodiment, a database storage 10. It is to be noted that all circuit configurations shown in the present Specification should be construed as being simply illustrative and not limiting the invention.

The database storage 10 stores a database containing a table of data showing a relationship among the anode voltage Va, the gas flow rate Q and the coil current Ic, wherein this relationship used to suppress oscillations of the anode current is expressed by a function related to the anode voltage Va and the coil current Ic. The control unit 9 controls the anode voltage Va, the gas flow rate Q and the coil current Ic based on the database stored in the database storage 10 in a manner that reduces the anode current oscillation. It is possible to reduce fluctuations in the magnitude of ion acceleration which is the output of the Hall thruster 11 by reducing the anode current oscillation in this way.

As the power supply apparatus 1 of this embodiment is provided with the database storage 10, it is possible to store a database of combinations of tabulated values of the three parameters, that is, the anode voltage Va, the gas flow rate Q and the coil current Ic, at which the discharge oscillation is unlikely to occur even in a region where a theory concerning the occurrence of the discharge oscillation is not applicable, wherein such combinations of the values of the three parameters are obtained from an experiment conducted in advance. Also, if there exist discrete conditions under which the discharge oscillation is unlikely to occur, such conditions defined by discrete combinations of the values of the three parameters are stored in the database of the database storage 10, so that the control unit 9 can control the Hall thruster 11 in a stable fashion.

The power supply apparatus 1 of the fifth embodiment is provided with the database storage 10 for storing combinations of the values of the anode voltage Va, the gas flow rate Q and the coil current Ic which can reduce the anode current oscillation. As the control unit 9 controls the Hall thruster 11 in the aforementioned manner, the power supply apparatus 1 of the embodiment can operate the Hall thruster 11 (ion accelerator) in a stable fashion in which the discharge oscillation is unlikely to occur.

While the invention has thus far been described with reference to the Hall thruster 11 (ion accelerator) used as a propulsion device mounted on an artificial satellite, the invention is also applicable to an apparatus having the same configuration as the Hall thruster 11 of the foregoing embodiments that is used as ion source device. Also, the invention is applicable not only to an ion source device having an annular channel structure but to a wide range of devices provided with three functional features involving producing a gas flow, applying a voltage and forming a magnetic field.

Various modifications and alterations of this invention will be apparent to those skilled in the art without departing from the scope and spirit of this invention, and it should be understood that this is not limited to the illustrative embodiments set forth herein.

What is claimed is:

1. A power supply apparatus for controlling an ion accelerator which is provided with an anode, a gas flow rate regulator and a magnetic field generating coil, said power supply apparatus comprising:

a controller for adjusting the magnitude of ion acceleration by said ion accelerator by controlling anode voltage applied to the anode, flow rate of gas flowed through the gas flow rate regulator and coil current flowed through the magnetic field generating coil;

wherein said controller controls the anode voltage, the gas flow rate and the coil current according to a quantity expressed by a function related at least to the anode voltage and the coil current.

2. The power supply apparatus for controlling the ion accelerator according to claim 1, wherein said controller controls said ion accelerator such that the coil current is kept approximately proportional to a value obtained by multiplying the root of the anode voltage by the root of the gas flow rate.

3. The power supply apparatus for controlling the ion accelerator according to claim 1, wherein said controller controls said ion accelerator such that the coil current is kept approximately proportional to the anode voltage.

4. The power supply apparatus for controlling the ion accelerator according to claim 1, wherein said controller controls the anode voltage, the gas flow rate and magnetic flux density at an ion exit of said ion accelerator which is dependent on the coil current such that an inequality given below is satisfied, said inequality containing as variables a cross-sectional area of the ion exit of the ion accelerator, ion acceleration zone length of said ion accelerator and a magnetic flux bias ratio representing the ratio of the magnetic flux density at the ion exit to a mean value of magnetic flux densities along an ion acceleration direction of said ion accelerator:

$$200\times10^9 < \frac{\beta\cdot V_a\cdot Q}{d\cdot S\cdot B^2} < 500\times10^9$$

where S=cross-sectional area of the ion exit ($m^2$);

d=ion acceleration zone length (m);

β=magnetic flux bias ratio;

Va=anode voltage (V);

Q=gas flow rate (sccm); and

B=magnetic flux density at the ion exit (T).

5. The power supply apparatus for controlling the ion accelerator according to claim 1, wherein, during startup of said ion accelerator, said controller controls said ion accelerator such that the coil current begins to flow before application of the anode voltage and such that the coil current is kept approximately proportional to the value obtained by multiplying the root of the anode voltage by the root of the gas flow rate until the anode voltage stabilizes after application thereof.

6. The power supply apparatus for controlling the ion accelerator according to claim 1, wherein, during startup of said ion accelerator, said controller controls said ion accelerator such that the coil current begins to flow before application of the anode voltage and such that the coil current is kept approximately proportional to the anode voltage.

7. The power supply apparatus for controlling the ion accelerator according to claim 1, wherein said controller controls said ion accelerator such that the coil current is kept approximately proportional to the value obtained by multiplying the root of the anode voltage by the root of the gas flow rate when the magnitude of ion acceleration is being altered.

8. The power supply apparatus for controlling the ion accelerator according to claim 1, wherein said controller controls said ion accelerator such that the coil current is kept approximately proportional to the anode voltage when the magnitude of ion acceleration is being altered.

9. The power supply apparatus for controlling the ion accelerator according to one of claim 1, said power supply apparatus further comprising:

a database storage storing a database containing a table of data showing a relationship among the anode voltage, the gas flow rate and the coil current, said relationship being expressed by the function related at least to the anode voltage and the coil current;

wherein said controller controls the anode voltage, the gas flow rate and the coil current based on the database stored in said database storage.

* * * * *